US007051379B2

(12) United States Patent
Lambert

(10) Patent No.: US 7,051,379 B2
(45) Date of Patent: May 30, 2006

(54) PROTECTIVE HEAD GEAR

(76) Inventor: Leo P. Lambert, 14 Trout Brook Rd., Dracut, MA (US) 01826

( * ) Notice: Subject to any disclaimer, the term of this patent is extended or adjusted under 35 U.S.C. 154(b) by 77 days.

(21) Appl. No.: 10/831,536

(22) Filed: Apr. 23, 2004

(65) Prior Publication Data

US 2004/0250341 A1 Dec. 16, 2004

Related U.S. Application Data

(60) Provisional application No. 60/475,142, filed on Jun. 2, 2003.

(51) Int. Cl.
*A42B 3/00* (2006.01)

(52) U.S. Cl. ..... 2/411; 2/171; 2/425; 2/909

(58) Field of Classification Search ..... 2/209.3, 2/DIG. 11, 411, 412, 414, 181, 171, 909, 2/425
See application file for complete search history.

(56) References Cited

U.S. PATENT DOCUMENTS

| | | | | | |
|---|---|---|---|---|---|
| 1,491,146 | A * | 4/1924 | Larson | 297/393 |
| 2,333,987 | A * | 11/1943 | Dandy | 2/425 |
| 2,422,116 | A * | 6/1947 | Mauro | 2/414 |
| 2,442,052 | A * | 5/1948 | Mauro | 2/412 |
| 2,546,842 | A * | 3/1951 | Yealdhall | 2/425 |
| 3,087,166 | A * | 4/1963 | Howard | 2/420 |
| 3,103,015 | A * | 9/1963 | Plastino | 2/422 |
| 3,457,563 | A * | 7/1969 | Marchello | 2/414 |
| 5,075,903 | A * | 12/1991 | Richoux | 2/411 |
| 5,581,818 | A * | 12/1996 | Lorenzi et al. | 2/411 |
| 5,657,492 | A * | 8/1997 | Esposito, Jr. | 2/410 |
| 5,882,205 | A * | 3/1999 | Peterson | 434/251 |
| 5,946,734 | A * | 9/1999 | Vogan | 2/412 |
| 6,339,849 | B1 | 1/2002 | Nelson et al. | |
| 6,397,399 | B1 * | 6/2002 | Lampe et al. | 2/425 |
| 6,425,141 | B1 | 7/2002 | Ewing et al. | |
| 6,427,253 | B1 * | 8/2002 | Penny | 2/412 |
| 6,446,271 | B1 * | 9/2002 | Ho | 2/414 |
| 6,691,324 | B1 * | 2/2004 | Nakamura | 2/425 |
| 6,842,914 | B1 * | 1/2005 | Broadway | 2/425 |
| 2002/0189004 | A1 * | 12/2002 | Aaron | 2/411 |
| 2004/0250341 | A1 * | 12/2004 | Lambert | 2/425 |
| 2005/0044611 | A1 * | 3/2005 | Abraham | 2/411 |

* cited by examiner

*Primary Examiner*—Rodney Lindsey
(74) *Attorney, Agent, or Firm*—Hamilton, Brook, Smith & Reynolds, P.C.

(57) ABSTRACT

A protective head gear includes a protective portion for covering at least part of the back of a user's head. A headband strap is included for extending from the protective portion at the back of the user's head to the user's forehead to hold the protective portion in place at the back of the user's head.

21 Claims, 3 Drawing Sheets

PROTECTIVE HEAD GEAR

RELATED APPLICATION

This application claims the benefit of U.S. Provisional Application No. 60/475,142, filed Jun. 2, 2003. The entire teachings of the above application are incorporated herein by reference.

BACKGROUND

Most types of protective head gear or helmets cover and protect the entire or majority of the user's head. For many activities that require protection of the head, maximum protection is desirable. However, there are some activities where only some protection is desired.

SUMMARY

The present invention includes a protective head gear having a design in which desired regions of the user's head are protected without covering the majority of the user's head.

Typically, the protective head gear includes a protective portion for covering at least part of the back of the user's head. A headband strap is included for extending from the protective portion at the back of the user's head to the user's forehead to hold the protective portion in place at the back of the user's head.

In preferred embodiments, the protective portion includes an outer shell and can also include a padded insert. A sleeve, often made of cloth, can be employed to cover the protective portion. Typically, the headband strap is adjustable, enabling the protective head gear to be adjusted for different head sizes.

The present invention also includes a protective head gear including a head gear portion. A protective portion is held by the head gear portion for protecting only the back of a user's head.

In one embodiment, the head gear portion can be a headband. In other embodiments, the head gear portion can be a hat where the hat has a pocket at a rear region of the hat for containing the protective portion. The protective portion can include an outer shell and/or a padded insert. The hat can be, for example, a knit hat or a baseball-type cap.

The protective head gear of the present invention can be worn by persons desiring protection in particular regions of the head, such as the back of the head, but where coverage of the entire or majority of the head with a helmet is not desired. Embodiments of the protective head gear of the present invention can be worn as a protective headband or sweatband unit. Such a protective head gear can protect the back of the user's head during a fall on his/her back side, but does not have the weight or bulky appearance of a full helmet. As a result, with such a design, the user's vision or hearing is not obscured and overheating of the head is minimized. The protective head gear can be worn by people engaged in activities on slippery surfaces such as ice, for example, sports such as curling.

BRIEF DESCRIPTION OF THE DRAWINGS

The foregoing and other objects, features and advantages of the invention will be apparent from the following more particular description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Figure 1:
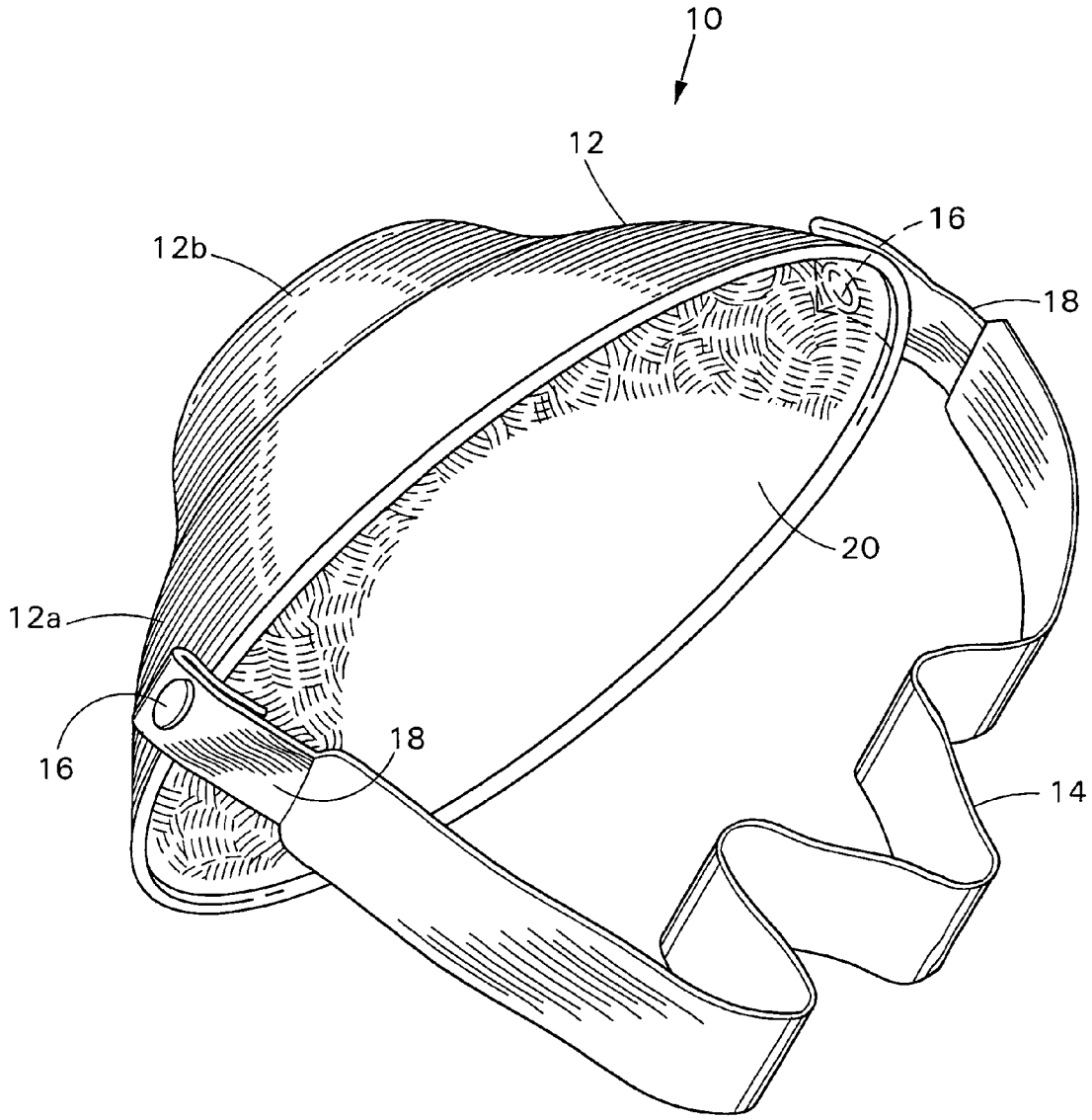
FIG. 1 is a perspective view of an embodiment of the present invention protective head gear.
Figure 2:
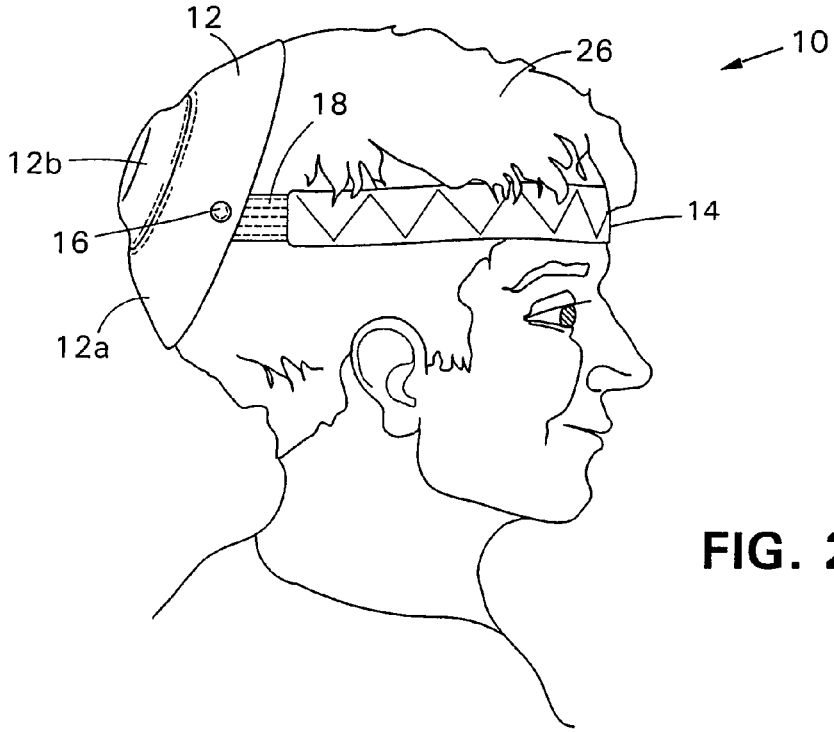
FIG. 2 is a side view of a user wearing the protective head gear.

FIGS. 1 and 2 depict an embodiment of the present invention in which protective head gear 10 includes a protective outer shell 12 for covering and protecting the back of the user's head 26. The outer shell 12 is contoured or shaped to fit over at least part of the back of the head 26. A headband strap 14 is secured to opposite edges or sides of the outer shell 12. When the headband strap 14 is extended across the forehead of the user's head 26, the outer shell 12 can be retained by the headband strap 14 in place against the back of the head 26. Typically, the headband strap 14 extends generally along or close to the hair line of the user's head 26. Since the outer shell 12 only covers a portion of the head 26 of the user, the protective head gear 10, in comparison to traditional helmets, is relatively small, light weight, does not obscure the user's vision or hearing, and minimizes heat buildup on the user's head 26.

The small size of the outer shell 12 in combination with the headband strap 14 of protective head gear 10 has a more pleasing appearance than a helmet that provides full coverage of the head. Additionally, users having long hair can drape their hair over the outer shell 12 and at least a portion of the headband strap 14 so that the user appears to be wearing only a headband. In some cases, the headband strap 14 might almost be completely covered. As a result, the protective head gear 10 can provide protection to the back of the user's head 26 in the event of falling on his/her back side without having the appearance of a traditional helmet. Protective head gear 10 may be desired for protecting the back of one's head from getting hit during a fall by those performing activities on slippery surfaces, for example, ice, including sports such as curling, or for persons prone to falling such as the elderly or people with physical disabilities. Other desired uses can be in sports where helmets are not traditionally worn but where falling is common, such as basketball.

A more detailed description of protective head gear 10 now follows. The outer shell 12 is formed of a hard plastic such as high-density polyethylene. In the embodiment depicted in FIGS. 1 and 2, outer shell 12 has a round bowl shape with a curved convex exterior and concave interior. The outer shell 12 has a curved outer rim 12*a* and a curved central cupped portion 12*b* with a smaller radius of curvature than the outer rim 12*a*. The combination of the outer rim 12*a* and central cupped portion 12*b* helps locate and retain the outer shell 12 on the desired region of the back of the user's head 26. The curved exterior of the outer shell 12 can be shaped to generally follow the contours of the user's head 26 for appearance. Typically, the outer shell 12 extends at least part way around the lower curved region of the back of the head 26 near the neck for a secure fit. Any impact on the outer shell 12 is absorbed and distributed over a larger area of the head 26, thereby reducing the actual force to the head 26 and reducing the chance of injury. The user's head 26 is usually spaced away from at least a portion of the inner surface of the outer shell 12 so that if the user falls backward onto the outer shell 12, the impact is normally not directly transferred to the head 26 at the location of impact, but rather along surrounding regions, such as the outer rim 12*a* of outer shell 12. In the embodiment depicted in FIGS. 1 and 2, the central cupped portion 12*b* is shaped to form a gap between the user's head 26 and the inner surface of the central cupped portion 12*b*. In addition, portions of the outer rim 12*a* can be shaped to be spaced from the user's head 26.

Figure 3:
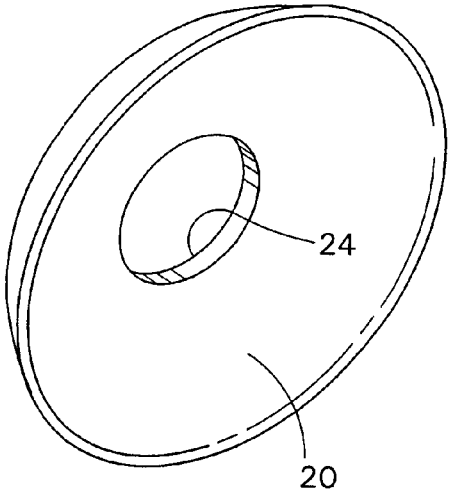
FIG. 3 is a perspective view of a padded insert for the protective head gear.

A padded insert 20 (FIGS. 1 and 3) is positioned within the outer shell 12 for comfort as well as to further absorb forces. In most cases, the padded insert 20 keeps the outer shell 12 from directly contacting the user's head 26. The padded insert 20 usually experiences some compression when the protective head gear 10 is worn. The padded insert 20 is typically held within the outer shell 12 by hook and loop fastener such as by VELCRO®, in order to allow removal for cleaning. Alternatively, padded insert 20 can be held in place by other common methods such as snaps, buttons, laces, straps, adhesives, sewing, etc. Padded insert 20 is commonly formed of foam, open or closed cell, or a combination of both, but alternatively can be formed of or include other common padding materials, for example, cotton, wool, force absorbing gel, inflatable or inflated air bladder(s), etc. The padded insert can have a hole 24 (FIG. 3) to help locate the padded insert 20 and the outer shell 12 at the back of the head 26. The padded insert 20 can also have a curved interior surface for conforming around the head 26, and for locating or positioning purposes. Although the padded insert 20 is shown to be contained within outer shell 12, in some situations the padded insert 20 can be larger than the outer shell 12 and extend beyond the boundaries of outer shell 12.

Referring to FIGS. 1 and 2, in one embodiment headband strap 14 is attached to outer shell 12 by snaps 16 and can be removable. Other common methods of attachment can be employed, such as with hook and loop fastener, buckles, loops, rivets, slots in outer shell 12, etc. Adjustment portions 18 are normally included for lengthening or shortening headband strap 14 and can be any of a number of common methods for adjusting the length of straps. Although two adjustment portions 18 are shown, in some cases, only one adjustment portion 18 may be desirable. The headband strap 14 in some embodiments is formed of non-stretchable material, but alternatively, can be elastic or include elastic portions for resiliently holding the outer shell 12 in place against the back of the user's head 26. The headband strap 14 is attached to outer shell 12 typically at a location which provides a retaining force generally directed along the midpoint or central regions of the outer shell 12 in a direction substantially perpendicular thereof to achieve a firm fit which minimizes unwanted shifting or movement of the protective head gear 10. Although the headband strap 14 is usually attached to the outer shell 12, in some embodiments, the headband strap 12 can be attached to the padded insert 20. In addition, headband strap 14 can include padded and/or outer shell portions to provide further protection to other regions of the head 26, for example, along the sides of the head 26 or the forehead. Furthermore, headband strap 14 can include or be formed of sweat absorbing material.

Figure 4:
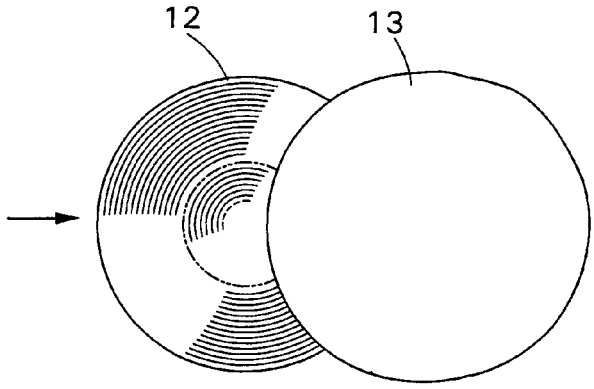
FIG. 4 depicts the insertion of the outer shell into a sleeve.

Referring to FIG. 4, the outer shell 12 can be inserted within a sleeve 13 such as made of cloth, vinyl, non-woven fabric, etc. The sleeve 13 can include various colors, patterns, numbers, text, logos, etc., as desired, and can match the clothing of the user or be part of a uniform. Typically, sleeve 13 includes openings through which headband strap 14 can extend. The sleeve 13 can also include padding. Alternatively, the outer shell 12 itself can be decorated with colors, patterns, numbers, text, logos, etc., instead of employing sleeve 13. In such a case, there may be instances where a sleeve 13 can be employed to cover or change the existing colors, patterns, numbers, text, logos, etc., on outer shell 12.

Figure 5:
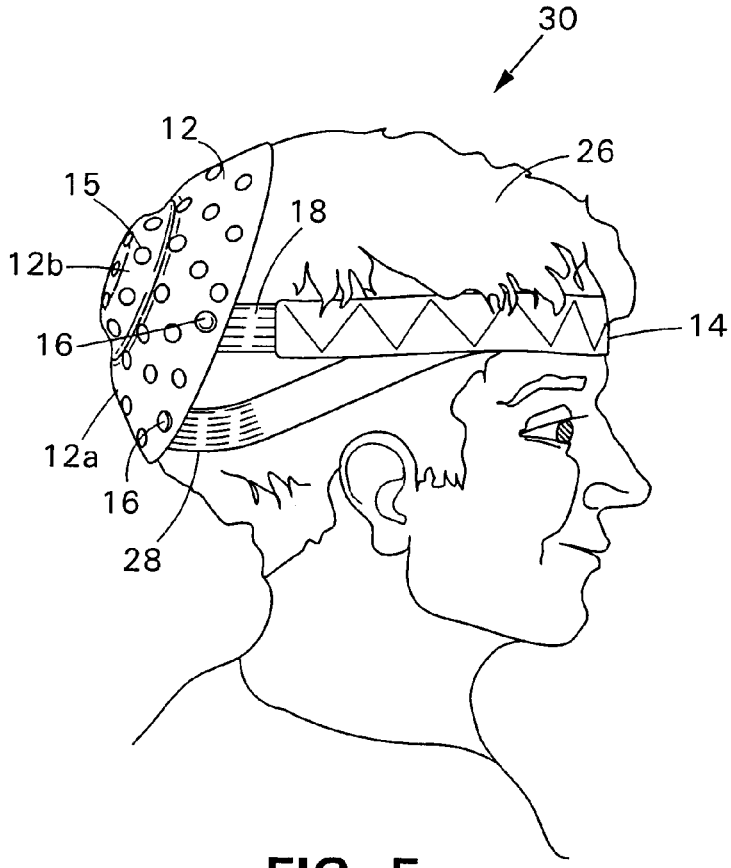
FIG. 5 is a side view of a user wearing another embodiment of the protective head gear.

Referring to FIG. 5, protective head gear 15 is another embodiment of the present invention which differs from protective head gear 10 in that outer shell 12 has a series of apertures or holes 15 extending therethrough for ventilation purposes. In addition, headband strap 14 has a secondary strap portion 28 extending to a lower point on the outer shell 12 for further stabilizing the outer shell 12 at the back of the head 26. In some embodiments, instead of having a secondary strap portion 28, headband strap 14 can have a widened portion for attachment to the outer shell 12.

Figure 6:
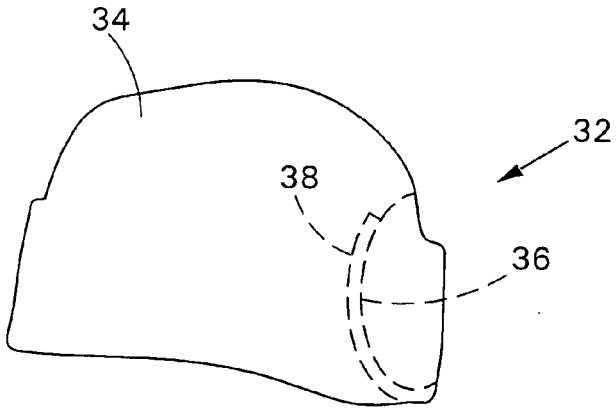
FIG. 6 is a side view of yet another embodiment of the protective head gear.

Referring to FIG. 6, protective head gear 32 is yet another embodiment in the present invention. Protective head gear 32 includes a common hat 34, for example, a knit hat, which is worn by the user. The hat 34 can cover the top, sides and forehead of the user's head 26. A protective insert 36 is located at the back of the hat 34 for protecting the back of the user's head 26. The protective insert 36 can be retained at the back of the hat 34 within a pocket 38. Alternatively, the protective insert 36 can be retained by other conventional means such as straps, snap fasteners, Velcro®, etc. The protective insert 36 can be constructed in a similar manner to that described above, as well as with the alternatives described further below. Although the hat 34 can cover the top, sides and forehead of the user's head 26, the protective head gear 32 does not have a bulky appearance if the only protective insert 36 is at the back for protecting the back of the head. Such a hat can have the general appearance of a normal hat. Alternatively, protective portions can also be positioned to protect regions other than the back of the head.

Figure 7:
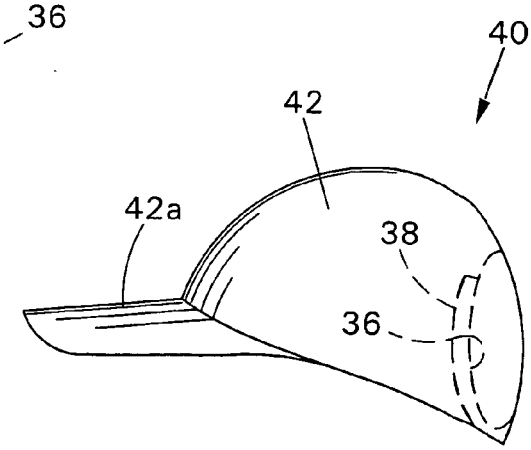
FIG. 7 is a side view of still another embodiment of the protective head gear.

Referring to FIG. 7, protective head gear 40 is still another embodiment in the present invention. Protective head gear 40 includes a baseball-type cap 42 having a visor 42*a*. The protective insert 36 can be located at the back of the hat 42 within a pocket 38 or by other suitable means.

While this invention has been particularly shown and described with references to preferred embodiments thereof, it will be understood by those skilled in the art that various changes in form and details may be made therein without departing from the scope of the invention encompassed by the appended claims.

For example, the padded insert 20 can be replaced with strap members or sheet material such as fabric, vinyl, leather, etc., extending across the interior of outer shell 12 spaced from the interior surface of at least a portion of outer shell 12. In addition, although the perimeter of outer shell 12 has been shown to be generally circular in shape, alternatively, the outer perimeter of outer shell 12 can have other suitable shapes, for example, generally oval, rectangular, triangular, combinations of curves, lines, and/or shapes, etc. Despite the perimeter shape employed, the interior of the outer shell 12 can still be contoured for fitting the back of the user's head 26. Also, the outer shell 12 does not have to have a central cupped portion 12*b*, but instead can be continuously curved for a smoother appearance. The outer shell 12 can also have portions extending along at least a portion of the sides of the user's head 26 to provide increased protection. This can also provide increased stability for the outer shell 12 when worn. Such portions extending along the side of the user's head 26 can in some embodiments cover the ears. In addition, although outer shell 12 is typically formed of rigid impact resistant plastic, other suitable materials can be employed, such as metal, for example, aluminum or steel, KEVLAR®, soft or flexible plastic, or high density foam, etc. If desired, the outer shell 12 can be formed in segments. In some cases where the material or shape of outer shell 12 itself provides sufficient shock protection and comfort, the padded insert 20 can be omitted. Alternatively, where the padded insert 20 provides sufficient shock protection, the outer shell 12 can be omitted. Furthermore, in some embodiments, headband strap 14 can include an additional strap that extends over the top of the user's head 26 to prevent the outer shell 12 and/or the headband strap 14 from slipping in the downward direction. Although the embodiments of the present invention depicted in FIGS. 1, 2 and 5 protect the back of the user's head 26, alternatively, other regions of the head 26 can be protected, for example, the front and/or sides of the head 26 can be protected with the headband strap extending around the back of the head 26. Finally, various features described above for the present invention can be combined or omitted.

What is claimed is:

1. Protective head gear comprising:

a protective portion for covering at least part of the back of a user's head, the protective portion including a shell having a concave interior with an outer rim portion and a cupped central portion, the cupped central portion having a smaller radius of curvature than the outer rim portion for forming an impact distributing structure; and a headband strap for extending from the protective portion at the back of the user's head to the user's forehead to hold the protective portion in place at the back of the user's head.

2. The protective head gear of claim 1 in which the shell of the protective portion defines a round bowl shaped outer shell.

3. The protective head gear of claim 2 in which the protective portion includes a padded insert.

4. The protective head gear of claim 1 in which the headband strap is adjustable.

5. The protective head gear of claim 1 in which the protective portion further includes a cloth sleeve.

6. Protective head gear comprising:

a head gear portion; and a protective portion held by the head gear portion for protecting only the back of a user's head, the protective portion including a shell having a concave interior with an outer rim portion and a cupped central portion, the cupped central portion having a smaller radius of curvature than the outer rim portion for forming an impact distributing structure.

7. The protective head gear of claim 6 in which the head gear portion comprises a headband.

8. The protective head gear of claim 6 in which the head gear portion is a hat.

9. The protective head gear of claim 8 in which the hat has a pocket at a rear region of the hat for containing the protective portion.

10. The protective head gear of claim 9 in which the shell of the protective portion defines an a round bowl shaped outer shell.

11. The protective head gear of claim 10 in which the protective portion includes a padded insert.

12. The protective head gear of claim 9 in which the hat is a knit hat.

13. The protective head gear of claim 9 in which the hat is a baseball-type cap.

14. A method of protecting the back of a user's head comprising:

wearing a head gear portion on the head; and holding a protective portion with the head gear portion that protects only the back of the head, the protective portion including a shell having a concave interior with an outer rim portion and a cupped central portion, the cupped central portion having a smaller radius of curvature than the outer rim portion for forming an impact distributing structure.

15. The method of claim 14 further comprising providing a headband strap as the head gear portion, the headband strap extending from the protective portion at the back of the user's head to the user's forehead to hold the protective portion in place at the back of the head.

16. The method of claim 14 further comprising providing that the shell of the protective portion define a round bowl shaped outer shell.

17. The method of claim 16 further comprising providing the protective portion with a padded insert.

18. The method of claim 14 further comprising providing a hat as the head gear portion.

19. The method of claim 18 further comprising containing the protective portion within a pocket at a rear region of the hat.

20. The method of claim 19 further comprising providing a knit hat as the hat.

21. The method of claim 19 further comprising providing a baseball-type cap as the hat.

* * * * *